US005242022A

United States Patent [19]

Burton et al.

[11] Patent Number: 5,242,022

[45] Date of Patent: Sep. 7, 1993

[54] METHOD AND APPARATUS FOR ISOLATING A ZONE OF WELLBORE AND EXTRACTING A FLUID THEREFROM

[75] Inventors: Guy C. Burton, Teton Village; Mickey W. Eckhart, Evansville; Thomas J. McCaffrey; James F. McCaffrey, both of Casper, all of Wyo.

[73] Assignee: Paul Hattich GmbH & Co., Kirchlengern, Fed. Rep. of Germany

[21] Appl. No.: 741,253

[22] Filed: Aug. 5, 1991

[51] Int. Cl.[5] ..... E21B 34/06

[52] U.S. Cl. ..... 166/386; 166/242; 166/317

[58] Field of Search ..... 166/386, 285, 317, 318, 166/319, 325, 332, 334, 242

[56] References Cited

U.S. PATENT DOCUMENTS

| | | | |
|---|---|---|---|
| 3,865,188 | 2/1975 | Doggett et al. | 166/285 |
| 3,971,441 | 7/1976 | Knowles et al. | 166/285 |
| 3,984,988 | 10/1976 | Portier | 61/35 |
| 3,994,138 | 11/1976 | Herbst | 61/39 |
| 4,162,705 | 7/1979 | Daigle | 166/186 |
| 4,427,070 | 1/1984 | O'Brien | 166/317 |
| 4,569,396 | 2/1986 | Brisco | 166/305.1 |
| 4,600,056 | 7/1986 | Burton, Jr. | 166/291 |
| 4,655,286 | 4/1987 | Wood | 166/285 |
| 4,685,520 | 8/1987 | McDaniel | 166/332 |
| 4,714,117 | 12/1987 | Dech | 166/380 |
| 4,848,457 | 7/1989 | Lilley | 166/332 X |
| 4,928,772 | 5/1990 | Hopmann | 166/332 X |

FOREIGN PATENT DOCUMENTS

| | | | |
|---|---|---|---|
| 2040342 | 8/1980 | United Kingdom | 166/317 |

*Primary Examiner*—Terry Lee Melius
*Attorney, Agent, or Firm*—Peter K. Kontler

[57] ABSTRACT

A method and apparatus for isolating a zone (12) of a wellbore (14) penetrated by a casing (16) and then opening ports (28) in the zone (12) for extraction or injection of fluids is provided. The zone (12) is isolated by inflating jackets (42) and then closing a safety valve (38) by sliding a sliding member (44) relative to a first conduit (46). The ports (28) are opened by sliding a piston (80) of a sliding sleeve valve (76) so that openings (84) therein align with the ports (28). The invention provides improved zone isolation and reduced wear of seals (86) in the sliding sleeve valve (76).

18 Claims, 4 Drawing Sheets

METHOD AND APPARATUS FOR ISOLATING A ZONE OF WELLBORE AND EXTRACTING A FLUID THEREFROM

TECHNICAL FIELD OF THE INVENTION

This invention relates in general to tools for completing wells, and in particular to a method and apparatus for isolating a zone of a wellbore penetrated by a casing and then extracting a fluid from the zone.

BACKGROUND OF THE INVENTION

In many applications, e.g., the recovery of subterranean fluids such as oil or gas, it is useful to inject fluids into or remove fluids from a geologic formation. For example, in the recovery of oil, fluids are commonly pumped through a well to treat a formation and, thereafter, oil is recovered from the formation through the well. Typically, the development of a well includes, inter alia, drilling a wellbore, inserting a casing into the wellbore, and completing the well by cementing the casing in the wellbore and opening ports in the casing through which fluids may be injected into or removed from the formation.

In completing a well, it is desirable that a zone of a wellbore adjacent a targeted formation, such as a fluid producing formation, be isolated from other zones of the wellbore. For example, if such a targeted zone is not isolated, the cement poured into the well to hold the casing in place may flow upward though the annulus between the casing and the wellbore into the zone and interfere with fluid flow between the casing ports and the formation. Similarly, annular fluid flow between the wellbore and casing may result in reduced recovery of fluids, loss of treatment fluids, or infiltration of undesired materials into a targeted zone.

These problems have been addressed in the art through the use of isolation packers to reduce annular fluid flow into or out of the targeted zone. Packers are generally employed adjacent the zone to be isolated, e.g., above and below the zone, in the annulus between the casing and the wellbore wall. The packers may comprise cementitious layers, compression packers which expand under compression forces to fill the annulus, or inflation packers which comprise jackets that can be inflated to fill the annulus. Inflation packers have been found advantageous for many applications because they are easily and quickly deployed in vertical or non-vertical wells. Deployment of inflation packers is generally accomplished by simply pumping fluid through the casing and through an inflation valve and inflation tubing which are provided to allow and hold inflation of the jackets thereby achieving and maintaining isolation of the zone.

However, there are a number of problems associated with known inflation packers. First, a jacket when attached to the casing also includes external attachment of at least a portion of the inflation valve and tubing. Thus, as the casing is inserted or moved within the wellbore, the inflation valve or tubing may be torn off or perforated resulting in a non-operational packer as well as a possible leak in the casing. In addition, some inflation packers maintain relatively low inflation pressures thereby limiting the ability of the jackets to close off the annulus between the casing and the wellbore. Moreover, where the inflation packers are deployed in formations prone to form irregularly shaped wellbore walls, e.g., sand or shale formations, fluids may leak around the packers into or out of the targeted zone. Thus, it is desirable that an inflation packer be provided which reduces the likelihood of leakage to or from the casing or the zone to be isolated and provides increased likelihood of being operational once positioned in the wellbore.

After a zone has been isolated, ports in the casing may be opened to allow injection of fluids into or removal of fluids from the geologic formation. It is desirable that the ports may be selectively opened or closed so that the ports can be closed, for example, when the formation is not being worked or when the casing is moved within the wellbore and then opened for use. One known method for opening and closing ports is by using a sliding sleeve valve. Typical sleeve valves comprise a sleeve having circumferential seals such as 0-rings at the top and bottom edges thereof to seal against a wall of the casing. Thus, when the sleeve is positioned over a port, the sleeve substantially prevents fluid communication between an interior of the casing and the formation through the port. The port may be opened by moving the sleeve so that the sleeve is located entirely above or below the port (or, in the case of a non-vertical well, entirely to one side of the port) thereby exposing the port and allowing fluid flow.

One problem associated with known sleeve valves is the tendency of the circumferential seals to develop leaks. When the sleeve is moved from a first position wherein the port is covered by the sleeve to a second position wherein the sleeve is located entirely above or below the port, the circumferential seal passes over edges of the port. After a number of opening and closing cycles, the repeated contact between the seal and port edges may cause the seal to wear and eventually result in leakage. Additionally, the sleeves are usually repositioned by inaccurate means, i.e., by "feel" rather than by positive indicators. An additional problem associated with known sleeve valves is the inability to adjust the threshold actuation force necessary to open and close such valves. Thus, it is desirable that a sleeve valve be provided which allows ports to be opened and closed with reduced wear on the sleeve valve seals, provides positive indications as to when the valve is open and closed and allows adjustment of the threshold actuation force.

SUMMARY OF THE INVENTION

The present invention disclosed herein comprises a method and apparatus for isolating a zone of a wellbore and extracting a fluid therefrom. The present invention provides an inflation packer with a safety valve and jacket assembly which reduces the likelihood of leakage to or from the casing or the zone to be isolated. The present invention also provides a sliding sleeve valve to open and close ports in a casing which reduces the likelihood of valve seal wear and leakage. A sliding sleeve valve is also provided with a mechanism whereby the actuation force needed to open and close the valve may be adjusted.

In accordance with an embodiment of the present invention, a method and apparatus for sealing an inflatable jacket in a wellbore penetrated by a casing is provided. A valve comprising a conduit assembly and a mating member which is received by the assembly is positioned between the jacket and an interior of the casing. The mating member extends from the assembly into an interior of the casing when the valve is open.

The jacket is closed by moving the mating member relative to the conduit assembly so that a first conduit is closed serving as a safety seal.

In accordance with another embodiment of the present invention, a method and apparatus for isolating a zone of a wellbore penetrated by a casing is provided. An inflatable jacket is disposed between the casing and a wall of the wellbore such that the jacket provides an annular closure between the casing and the wall when the jacket is inflated. A safety valve is provided between the jacket and an interior of the casing to selectively allow fluid communication with the jacket. The safety valve comprises a conduit between the jacket and the casing interior, and a moveable valve member including an interior passageway having a first open end and a second end selectively enclosed by a knock-off cover. The member can be moved between a first position, wherein the open end is exposed allowing fluid communication between the conduit and the passageway, and a second position wherein a portion of the conduit seals the open end. The jacket can thereby be inflated by removing the knock-off cover and allowing fluid to flow from the casing interior through the passageway and the conduit to the jacket. The member can then be moved so that the open end is closed by a portion of the conduit to reduce the likelihood of backflow of fluid from the jacket to the casing interior.

In accordance with another embodiment of the present invention, a method and apparatus for opening and closing a port in a wellbore casing is provided. A valve comprising a sliding piston adjacent a wall of the casing or inner sleeve is moveable between a first position, wherein an opening in the piston is aligned with the port thereby allowing fluid flow through the casing wall, and a second position wherein the opening and port are misaligned thereby substantially preventing fluid flow. Circumferential seals may be provided in grooves in the casing adjacent the port, to prevent fluid leakage from the port to the opening when the valve is closed.

In accordance with a further embodiment of the present invention, a method and apparatus for use in opening and closing a sliding sleeve valve is provided. A groove cooperates with a spring loaded detent to guide a piston from a first position, wherein an opening in the piston is aligned with a port in a casing, to a second position wherein the port and opening are misaligned. Either the groove or the detent moves with the piston while the other of the groove or detent moves with the casing. The groove is formed with first and second spaced apart indentations, corresponding to the first and second positions, so that the detent is snappingly engaged therein to provide a positive indication as to whether the valve is in an open or closed position. A spring member, used to bias the detent towards the groove and indentations, may be selected such that a desired actuation force threshold which is necessary to overcome to open or close the valve is achieved.

It is an advantage of the present invention that a safety valve and jacket assembly is provided that reduces the likelihood of leakage to or from a casing or zone to be isolated. It is a further advantage of the present invention that a sliding sleeve valve to open and close ports in a casing is provided which reduces the likelihood of valve seal wear and leakage. It is a still further advantage of the present invention that a sleeve valve for opening and closing ports in a casing is provided wherein the actuation force needed to open and close the valve is adjustable.

BRIEF DESCRIPTION OF THE DRAWINGS

For a better understanding of the present invention and for further advantages thereof, reference is now made to the Detailed Description taken in conjunction with the accompanying Drawings, in which.

DETAILED DESCRIPTION OF THE INVENTION

Figure 1:
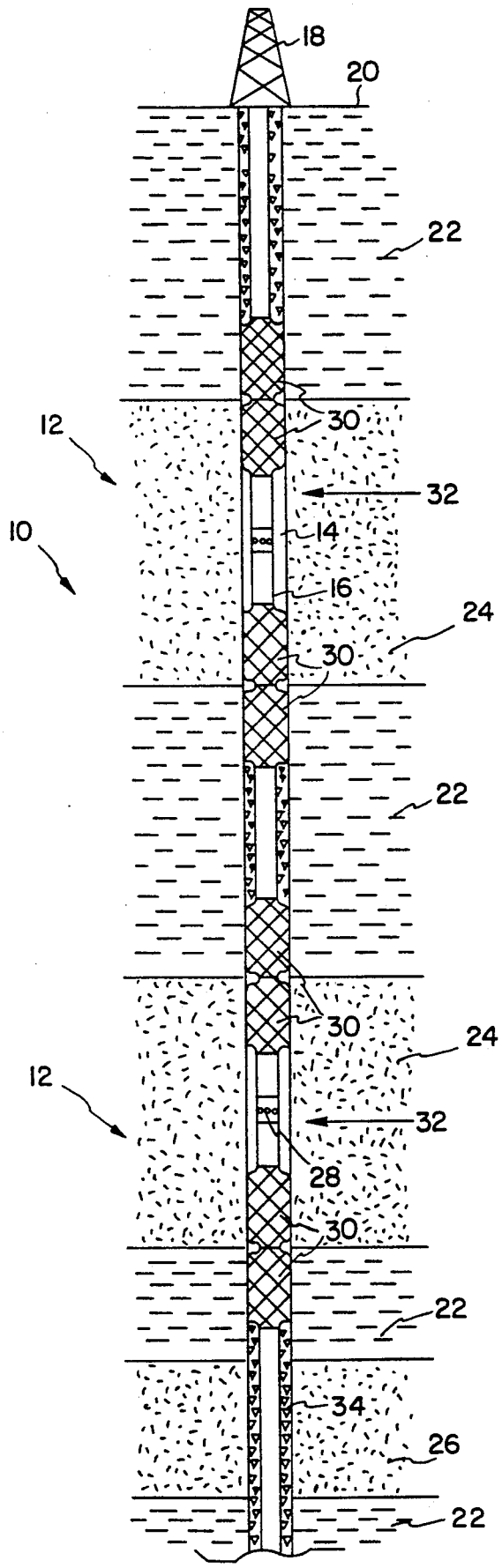
FIG. 1 is a side, cross-sectional elevation of an apparatus constructed in accordance with an embodiment of the present invention shown in connection with a wellbore penetrated by a casing.

In FIGS. 1–4, like items are identified by like and corresponding numerals for ease of reference. Referring first to FIG. 1, an apparatus constructed in accordance with the present invention is generally identified by the reference numeral 10. The apparatus 10 comprises an assembly for isolating one or more zones 12 of a wellbore 14 penetrated by a casing 16 and for extracting a fluid therefrom. As used herein, the term "casing" is used to refer to the string of conduit and interconnecting joints through which fluids are transported into or from the wellbore 14. It is to be understood that the casing 16 may comprise a series of longitudinally interconnected segments and that segments of the casing 16 may include valves or other functional members. In addition, although the invention will be described in the context of extracting hydrocarbon fluids, such as oil or gas, from a geologic formation, it will be understood that the present invention can be used to recover other fluids or to insert fluids, such as treatment fluids, into a geologic formation or wellbore.

According to the illustrated embodiment, the recovery of hydrocarbon fluids may be initiated by drilling the wellbore 14 from an oil rig 18 on the earth's surface 20 downwardly for perhaps several thousand feet. The wellbore 14 may penetrate several geologic formations including rock formations 22 such as shale, hydrocarbon fluid producing formations 24 such as gas sands, and non-hydrocarbon fluid formations 26 such as water sands. Completing the wellbore 14 involves inserting a casing 16 into the wellbore 14, isolating the zones 12 adjacent hydrocarbon producing formations 24, cementing the casing 16 in position in the wellbore 14 and opening ports 28 to allow the hydrocarbon fluids to flow into the casing 16. The illustrated apparatus 10 comprises an inflation packer assembly 30 for isolating the zones 12 and a sliding sleeve valve 32 for opening and closing ports 28 in the casing 16 adjacent the zones 12.

It is desirable that the zone 12 be isolated from other zones of the wellbore 14 for a number of reasons. First, isolation of the zone 12 keeps the cement annulus 34 used to hold the casing in place from flowing into the zone 12 and interfering with hydrocarbon fluid production from the formation 24. In addition, isolation of the zone 12 keeps hydrocarbons out of the cement annulus 34 thereby reducing the likelihood that the cement will fail to set properly. Isolation of the zone 12 also reduces the likelihood of escape of hydrocarbon fluids from the zone 12 or infiltration of undesired fluids into the zone 12.

Figure 2:
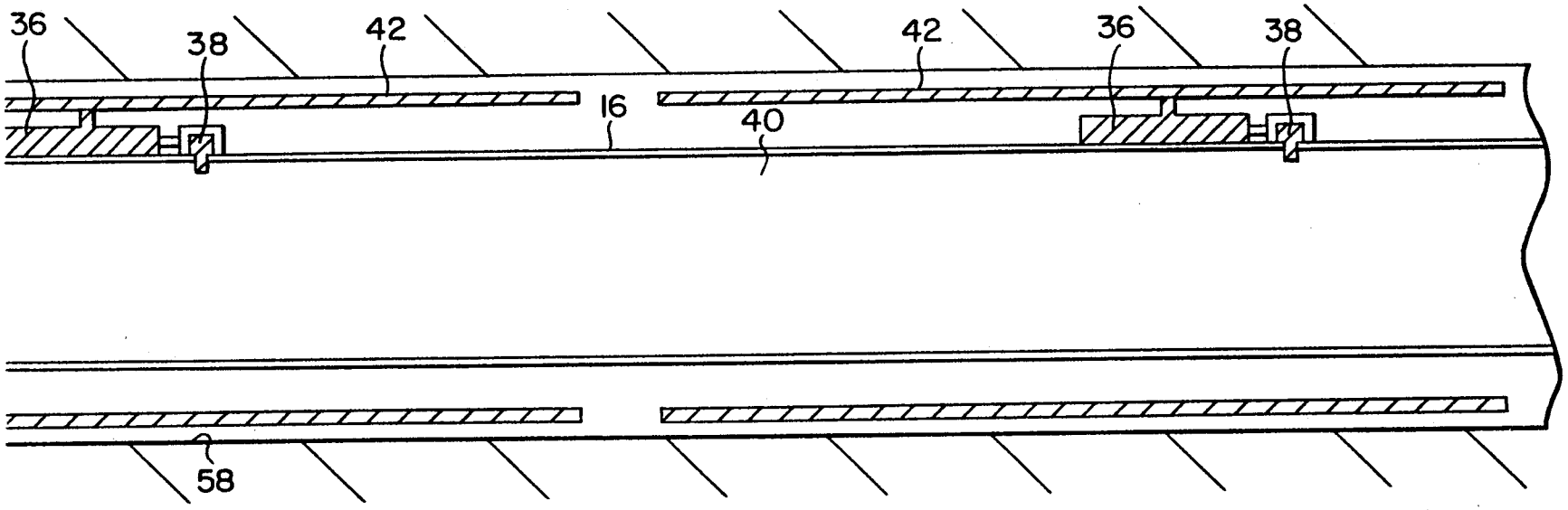
FIG. 2 is a side, cross-sectional elevation of an inflation packer assembly constructed in accordance with an embodiment of the present invention.

Referring to FIG. 2 a side cross-sectional elevation of an inflation packer assembly 30 is shown. In the illustrated embodiment, the assembly 30 comprises an inflation valve 36 and a safety valve 38 both positioned between the casing 16 and an inflatable jacket 42. It is an advantage of the present invention that the jacket 42 is positioned between valves 36 and 38 and wellbore wall 58 thereby reducing the likelihood of damage to the valves 36 and 38 from contact with the wall 58 of the wellbore 14. The positioning of the valves 36 and 38 beneath the jackets 42 also eliminates the exposure of inflation tubes as in the prior art which may be punctured. The jacket 42 can be inflated by flowing fluid from an interior portion 40 of the casing 16 to the jacket 42 through the inflation valve 36 and the safety valve 38 when the valves 36 and 38 are in open positions.

Figure 3A:
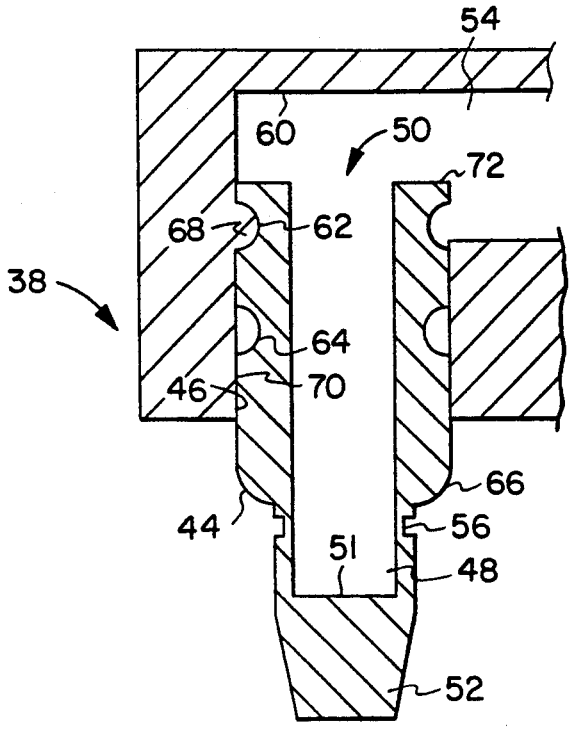
FIG. 3*a* is a side, cross-sectional elevation of a safety valve constructed in accordance with an embodiment the present invention in which the valve is in an open position.

Referring to FIG. 3*a*, the safety valve 38 comprises a mating member such as a sliding member 44 contained within a first conduit 46 such that the member 44 can slide longitudinally therein. The member 44 includes an internal passageway 48 having a first open end 50 and a second end 51 which is selectively covered by a knock-off cover 52. The knock-off cover 52 extends into the interior portion 40 of the casing 16 (FIG. 2) and is removable to allow fluid communication between the passageway 48 and the interior portion 40 for inflation of the jacket 42. The cover 52 is removed by passing a tool device longitudinally through the casing 16 to shear off the cover 52 which extends into the casing 16. A narrowed portion 56 of the member 44 is provided to facilitate removal of the cover 52. The tool device may comprise a cutting tool, a conduit, a cement block, or any other device by which a shearing force can be exerted on the cover 52. Thus, when the cover 52 is removed and the member 44 is in the open position shown in FIG. 3*a*, fluid can pass through the safety valve 38 from the interior portion 40 to a second conduit 54. As will be subsequently described in more detail, the safety valve 38 can be closed after inflation of the jacket 42 by sliding the member 44 to a second position to reduce the likelihood of backflow of inflation fluid from the conduit 54 to the interior 40.

Referring again to FIG. 2, The inflation valve 36 allows fluid communication between the conduit 54 and the jacket 42 until the jacket is inflated to a predetermined pressure. The valve 36 may comprise, for example, a check and block valve or a piston and cylinder valve having a suitable release mechanism whereby the piston or block can move to close a valve port when the predetermined pressure is reached, as is known in the art. Preferably the release mechanism is of a type which can be adjusted so that the actuation pressure needed to close the valve can be selected as wellbore conditions warrant. For example, where the jacket 42 is deployed in a formation prone to form irregularly shaped walls, e.g., shale or sand formations, a higher inflation pressure may be desired to ensure an adequate seal between the jacket 42 and wellbore wall 58.

Figure 3B:
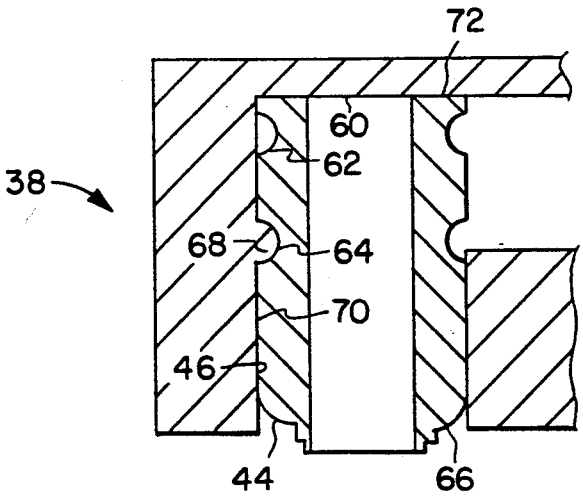
FIG. 3*b* is a side cross-sectional elevation of a safety valve constructed in accordance with an embodiment of the present invention in which the valve is in a closed position.

After the jacket 42 has been inflated to the predetermined pressure and the inflation valve 36 closes, the safety valve 38 may be moved to block the junction between the first conduit 46 and the second conduit 54 to reduce the likelihood of backflow from the jacket 42 to the interior portion 40 in the event of the failure or leakage of the inflation valve 36. Referring to FIG. 3*b*, the safety valve 38 is closed by moving the member 44 longitudinally away from the interior portion 40 from a first position (FIG. 3*a*), wherein the open end 50 is exposed allowing fluid communication between the passageway 48 and the conduit 54, to a second closed position (FIG. 3*b*), wherein the open end 50 is closed off by contact with a wall 60 of the conduit 54. The valve 38 is closed by passing a plug, such as a cement or other block, through the casing 16 so that the plug pushes the member 44 outwardly.

The safety valve 38 is provided with a mechanism whereby the sliding member 44 is snappingly engaged in first and second positions. As illustrated, the mechanism comprises a first indentation 62 and a second indentation 64 in an exterior surface 66 of the member 44 adapted to matingly engage a protrusion 68 extending from an internal surface 70 of the conduit 46. The indentations 62 and 64 comprise, for example, circumferential grooves shaped to fit snugly over the protrusion 68 so that the first and second positions are accurately determined. The indentations 62 and 64 and protrusion 68 may be of any corresponding geometric shapes. As illustrated, the indentations 62 and 64 and the protrusion 68 have a semi-circular cross-section which has been found advantageous in that the indentations 62 and 64 tend to center accurately over the protrusion 68. Other means for engaging the piston in the first and second positions could be provided. For example, an elastically biased member, such as a spring loaded detent, could be provided either on the external surface 66 or on the internal surface 70 to engage indentations in the opposite surface.

The valve 38 is closed by sliding the member 44 from a first position (FIG. 3*a*) wherein the protrusion 68 engages the first indentation 62 to a second position (FIG. 3*b*) wherein the protrusion 68 engages the second indentation 64. As described above, the member 44 is moved from the first position to the second position by a block which pushes the member 44 outwardly from the interior portion 40 of the casing 16. When the protrusion 68 is engaged within the first indentation 62, the open end 50 is exposed. However, when the protrusion 68 is engaged by the second indentation 64, the open end 50 is closed, for example, by the wall 60 thereby restricting fluid communication between the conduit 54 and the passageway 48. If desired, an elastic member such as a rubber seat may be provided on the wall 60 or on the base 72 of the member 44 to further decrease the likelihood of fluid flow through the valve 38 when the member 44 is in the second position.

Referring again to FIG. 2, the illustrated packer assembly 30 comprises a plurality of longitudinally spaced jackets 42, which cooperate to seal an end of the zone 12. The jackets 42 may comprise, for example, a rubber containing material such as Neoprene that is resistant to hydrocarbon fluids or other wellbore fluids. It is anticipated that the use of a plurality of jackets 42 will decrease the likelihood of leakage around the assembly 30 particularly when deployed in formations prone to form an irregularly shaped wellbore wall 58, such as sand and shale formations. The use of a plurality of jackets 42 also allows isolation of the zone 12 to be maintained in the event of failure of a single jacket 42 or failure of valves 36 and 38. Although not shown, it is to be understood that protective ends are provided on the casing 16 to reduce the likelihood of damage to the down hole ends of the jackets 42.

In operation, the zone 12 is isolated by inflating the jackets 42 to provide an annular seal between the casing 16 and wall 58 adjacent the zone 12. The jackets 42 are inflated by passing a tool through the casing 16 to shear the cover 52 from the member 44, and then pumping fluid into the casing 16 with the valves 36 and 38 open so that the fluid flows through the valves 36 and 38 to inflate the jackets 42. When a predetermined inflation pressure is reached, the inflation valve 36 closes thereby substantially preventing backflow of fluid from the jacket 42 through the inflation valve 36. The safety valve 38 may then be closed by passing a plug through the casing 16 so that the member 44 is pushed outwardly causing the member 44 to snap into the second position wherein the open end 50 is closed off by the wall 60 thereby reducing the likelihood of backflow of fluid into the interior 40. Thus, the valves 36 and 38 effectively allow and maintain inflation of the jackets 42.

Figure 4:
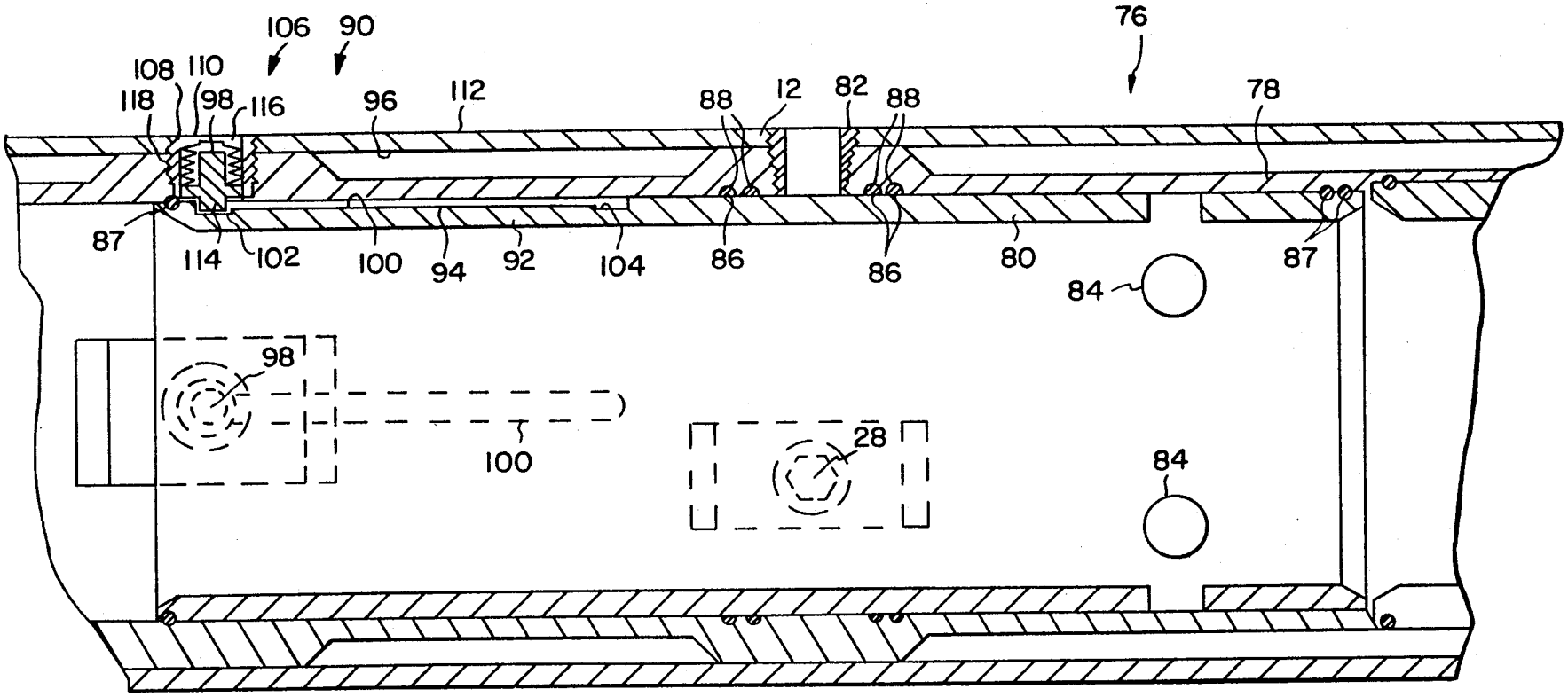
FIG. 4 is a side, cross-sectional elevation of a sliding sleeve valve constructed in accordance with an embodiment of the present invention.

Referring to FIG. 4, a side cross-sectional elevation of a sliding sleeve valve constructed in accordance with an embodiment of the present invention is generally identified by the reference numeral 76. After the zone 12 has been isolated the sliding sleeve valve 76 is used to open a plurality of ports 28 in the casing 16 to allow fluid flow into or out of the casing 16. The sliding sleeve valve 76 comprises a valve 78 which is fixed to the casing 16 and a piston 80 which can slide longitudinally relative to sleeve sleeve 78 and the casing 16. The ports 28 comprise openings through the casing 16 and the sleeve 78 lined by annular plugs 82 which are threadably attached to the casing 16 and sleeve 78. The plugs 82 thus serve both to define the ports 28 and to interconnect the sleeve 78 and the casing 16. The plugs 82 provide an advantage over the known prior art in that they are threaded into position rather than welded or cut. As is known, welding or cutting can result in non-homogenous metal which may cause a failure in the casing 16.

The sliding sleeve valve 76 is opened, thereby allowing fluid flow through the casing 16, sleeve 78 and piston 80 to an interior portion 40, by sliding the piston 80 so that openings 84 in the sleeve are aligned with the ports 28. In accordance with the present invention, the valve 76 may be opened by sliding the piston 80 longitudinally or rotationally. Preferably, the opposing surfaces of the piston 80 and cylinder are plated with a suitable material, such as nickel, to resist corrosion. In the illustrated embodiment, the valve 76 is opened by sliding the piston 80 longitudinally from a first position, wherein the openings 84 and ports 28 are misaligned, to a second position wherein the openings 84 and ports 28 line up so that fluid can pass through the casing 16 to the interior 40. Circumferential seals 86, such as 0-rings, are housed in slots 88 in the sleeve 78 adjacent the ports 28 thereby substantially preventing leakage of fluid from the ports 28 when the piston 80 is in the first position. Cylinder wipers 87 such as rubber seals may also be provided near the ends of the piston 80 to prevent leakage of fluids between the piston 80 and sleeve 78 as well as to reduce the likelihood of foreign material entering the ports 28 or the openings 84. It is an advantage of the present invention that the seals 86 are housed within the sleeve 78 rather than the piston 80, as in the prior art, so that the seals 86 are not moved across the ports 28, thereby reducing seal wear and the likelihood of failure. It has been found in the prior art that if the seals 86 are positioned in the external surface of the piston 80, pressure outside the casing 16 may tend to damage the seals 86. Such pressure does not exist interior to the casing 16. Additionally, since it is easier to machine the exterior edges around the openings 84 than it is to machine the interior edges around the ports 28, less damage occurs to the seals 28 when the openings 84 are moved past the seals 86 than if the seals 86 were to be moved past the ports 20. The seals 86 may comprise, for example, a Style 1200 fluoro-elastomer, available from Chesterton.

A mating assembly 90 is provided to guide the piston 80 between the first and second positions. The assembly 90 may comprise a plurality of protrusions such as a pins or detents, extending from an external surface 92 of the piston 80, an internal surface 94 of the sleeve 78 or an internal surface 96 of the casing 16 and a groove or slot on either an internal surface 94 or 96 or the external surface 92 to matingly receive the protrusions. In the illustrated embodiment, the assembly 90 comprises a plurality of detents 98 extending from the internal surfaces 94 and 96 into a plurality of guide slots 100 in the external surface 92 of the piston 80. A first indentation 102 and a second indentation 104 in the slots 100 are snappingly engaged by the detent 98, as will be described below, when the piston 80 reaches the first and second positions respectively. Thus, a positive indication is provided when the ports 28 are aligned with the openings 84, i.e., when the valve 76 is open. Similarly, a positive indication is provided the valve 76 is closed.

The detents 98 are generally "T" shaped and are biased towards the slots 100 and indentations 102 and 104 by elastic members such as, for example, rubber blocks or springs such that an end portion 114 of each detent 98 is urged toward the slot 100 and indentations 102 and 104. As illustrated, the detents 98 are biased by a spring loading assembly 106 which comprises a generally cylindrical plug 108 having a first end 110 which is substantially flush with an exterior surface 112 of the casing 16. The plug 108 is threadably attached to the casing 16 and the sleeve 78 thereby further serving to interconnect the casing 16 and sleeve 78. A spring member 116 is disposed between the first end 110 and an opposing surface 118 of the detent 98 to bias the detent 98.

The illustrated spring loading assembly 106 allows the spring member 116 to be adjusted so that the threshold actuation force necessary to move the piston 80 from the first or second positions may be adjusted. The threshold actuation force needed to disengage the detent 98 from the indentations 102 and 104 varies with spring constant, coil strength, or other measure of elasticity of the spring member 116. In the illustrated assembly 106, threshold actuation force can be varied by simply unthreading the plug 108 and replacing the spring member 116 with a different spring. Similarly, the threshold actuation force can be changed by adding or taking away springs or spring portions. The ability to vary the threshold actuation force provides the advantage that the force necessary to move the piston 80 may be varied as wellbore conditions warrant.

The piston 80 is moved between the first and second positions by a valve operating tool (not shown), as is well known in the art. For example, the valve operating tool may comprise a housing having spring loaded dogs embedded therein adapted to fit within the piston 80. The tool engages the piston 80 when the dogs spring from the housing into annular recesses (not shown) internal to the piston 80 provided to receive the dogs. The piston 80 then moves with the tool, e.g., as the tool is fed out or withdrawn in the casing 16 by way of tubing extending from the tool to the surface, between the first and second positions.

Thus, in the operation of the present invention, a well may be completed as follows. A zone 12 of the wellbore 14 is isolated by running a tool through the casing 16 to shear the knock-off cover 52 from the safety valve 38 and then pumping fluid through the casing 16 to inflate the jackets 42. A plug may then be run through the casing 16 to lock the safety valve 38 in a closed position. Thereafter, the casing 16 may be cemented in place in the wellbore 14 and ports 28 may be opened in the casing 16 adjacent the zone 12 to allow recovery of fluids through the casing 16. The ports 28 are opened by using a valve operating tool to move the piston 80 in the sleeve valve 76 from a first position wherein the openings 84 in the piston 80 are misaligned with the ports 28 in the casing 16, to a second position wherein the openings 84 and ports 28 are aligned thereby allowing fluid flow through the sleeve valve 76. Mating elements such as a detent 98 and slot 100 are provided to guide the piston 80 between the first and second positions and ensure that the openings 84 and ports 28 align properly. A method and apparatus is thereby provided for isolating a zone of a wellbore penetrated by a casing and then extracting a fluid therefrom.

The present invention has a number of advantages over prior art well completion methods and devices. First, the present invention reduces the likelihood of fluid leakage into or out of the isolated zone. The combination of the inflation valve and the safety valve allow a higher jacket inflation to be maintained thereby improving the seal between the jacket and the wellbore wall. It is anticipated ted that jacket inflation pressures of 120 psi will be maintainable according to the present invention. In addition, the provision of a plurality of longitudinally spaced jackets allows adequate isolation to be maintained in the event of single packer or valve failure or where a single jacket would provide inadequate isolation due to irregularities in the wellbore wall. Moreover, the positioning of the inflation valves and safety valves beneath the jackets eliminates the use of exposed inflation tubes and reduces the likelihood of valve damage due to contact with the wellbore wall as the casing is moved thereby increasing the likelihood that adequate jacket inflation will be achieved and maintained.

The present invention also provides an improved method and apparatus for opening and closing casing ports. The present invention allows a sliding sleeve valve to be moved between an open and a closed position with substantially reduced seal wear. In addition, an assembly is provided whereby the threshold actuation force needed to move the piston of the sleeve valve may be varied. The sleeve valve also provides positive indications when the valve reaches the open and closed positions.

Although the present invention has been described with respect to specific embodiments thereof, various changes and modifications may be suggested to one skilled in the art and it is intended that the present invention encompass such changes and modifications as fall within the scope of the appended claims.

What is claimed is:

1. An apparatus for closing an antiflatable jacket in a wellbore penetrated by a casing, comprising:

a conduit assembly extending between the jacket and an exterior surface of the casing, said conduit assembly including a first portion in communication with an exterior of the casing; and a mating member slidably received by said conduit assembly and eyeing into an interior of the casing, said conduit assembly including a second portion, said mating member positioned in said first portion of said conduit assembly wherein the jacket is closed by moving said mating member relative to said second portion of said conduit assembly so that said conduit assembly is closed.

2. The apparatus of claim 1, wherein said conduit assembly comprises:

first and second conduits, said first conduit extending transversely from said second conduit into the interior of the casing.

3. The apparatus of claim 2, further comprising:

an inflation valve positioned in said second conduit.

4. The apparatus of claim 3, wherein said inflation valve comprises:

means for substantially preventing backflow of fluid from the jacket when the inflation pressure of the jacket reaches a predetermined value.

5. The apparatus of claim 2, wherein said mating member comprises:

a first configuration in which said first conduit is in fluid communication with said second conduit.

6. The apparatus of claim 1, wherein an exterior surface of said mating member comprises:

first and second indentations adapted to engage a protrusion extending from an interior surface of said conduit assembly, wherein said jacket is closed by sliding said mating member longitudinally within said conduit assembly from a first position in which said first indentation engages said protrusion to a second position in which said second indentation engages said protrusion.

7. The apparatus of claim 6, wherein each of said indentations comprises:

a circumferential groove.

8. The apparatus of claim 1, wherein said mating member includes:

a knock-off cover for selectively preventing fluid communication between said conduit assembly and the interior of the casing.

9. The apparatus of claim 8, wherein:

said cover extends into the interior of the casing such that said cover can be removed by passing a device through the casing to shear said cover from said mating member, wherein fluid communication is allowed between said conduit assembly and the interior of the casing.

10. An apparatus for providing a seal in a wellbore, comprising:

a casing having at least a first port;

a sliding sleeve valve assembly disposed within said casing, said sliding sleeve valve assembly including a piston having at least a first opening therethrough, said piston moveable between a first position in which said first port aligns with said first opening to allow fluid flow across said casing and a second position in which said first port and said first opening are misaligned to substantially prevent fluid flow across said casing; and sealing means held in one of said casing and a portion of said sliding sleeve valve assembly other than said piston and continuously being adjacent to and surrounding said first port including when said piston is in said first position, said sealing means being stationary during movement of said piston between said first and second positions whereby seal wear is reduced as said sealing means is not moved across said first port.

11. An apparatus of claim 10, wherein:

one of said casing and said sliding sleeve valve assembly includes a sleeve and at least one of said sleeve and said piston has a detent extending therefrom, and the other of said sleeve and said piston has guide means formed therein, wherein said detent and said guide means cooperate to guide said piston between said first position and said second position, said guide means having a length substantially corresponding to a distance said piston moves in traveling between said second position and said first position.

12. An apparatus of claim 11, further comprising:

an elastic member to bias said detent towards said guide means and a plug threadably attached to said casing and said sleeve for use in interconnecting said casing and said sleeve.

13. An apparatus of claim 12, wherein said elastic member comprises:

a spring member having a predetermined force associated therewith, with said spring member being removable for varying said force by replacing said spring member.

14. An apparatus of claim 11, wherein said guide means comprises:

first and second indentations corresponding to said first and second positions and a longitudinal slot contiguous with each of said first and second indentations and extending therebetween, wherein said detent snappingly engages said indentations as said piston is moved to provide a position indication when said piston reaches each of said first and second positions.

15. An apparatus of claim 14, wherein aid elastic member comprises:

a spring member that biases said detent toward said longitudinal slot and said indentations so that a preselected threshold actuation force is required to move said piston between said first and second positions.

16. The apparatus of claim 11, wherein:

said detent extends from said casing toward said piston.

17. An apparatus for use in opening and closing a sliding sleeve valve in a casing positioned in a wellbore, comprising:

a detent extending from the casing of the wellbore; and a piston adjacent the casing having a longitudinal slot therein, wherein said detent and said slot cooperate to guide the valve between an open position and a close position, said slot having a length substantially corresponding to a distance said piston moves in traveling between said open position and said closed position.

18. A method for selectively opening and closing a sliding sleeve valve in a wellbore casing comprising the steps of:

biasing a detent on the casing to engage a first indentation within a slot on a piston of the valve in a closed position;

overcoming said detent biasing to move said piston; and moving said piston to align said detent with a second indentation in said slot to open the valve, said slot being in contiguous communication with each of said first and second indentations and said slot having a length substantially corresponding to a distance said piston moves in traveling between opening and closing the valve.

* * * * *

UNITED STATES PATENT AND TRADEMARK OFFICE

CERTIFICATE OF CORRECTION

PATENT NO. : 5,242,022

DATED : September 7, 1993

INVENTOR(S) : Guy C. Burton, Mickey W. Eckhart, Thomas J. McCaffrey, James F. McCaffrey It is certified that error appears in the above-identified patent and that said Letters Patent is hereby corrected as shown below:

On the title page: Item [73]

should read as follows: " TCF Tool, Inc., Casper, Wyoming "

Attorney, Agent, or Firm should read

" Sheridan, Ross & McIntosh"

Signed and Sealed this

Fourth Day of April, 1995

Bruce Lehman

*Attest:*

BRUCE LEHMAN

*Attesting Officer*

*Commissioner of Patents and Trademarks*